US011269366B2

(12) United States Patent
Shi

(10) Patent No.: US 11,269,366 B2
(45) Date of Patent: Mar. 8, 2022

(54) DIGITAL LOW-DROPOUT REGULATOR AND METHOD FOR OPERATING A DIGITAL LOW-DROPOUT REGULATOR

(71) Applicant: NXP B.V., Eindhoven (NL)

(72) Inventor: Minwen Shi, Eindhoven (NL)

(73) Assignee: NXP B.V., San Jose, CA (US)

( * ) Notice: Subject to any disclaimer, the term of this patent is extended or adjusted under 35 U.S.C. 154(b) by 14 days.

(21) Appl. No.: 16/888,512

(22) Filed: May 29, 2020

(65) Prior Publication Data

US 2021/0373589 A1 Dec. 2, 2021

(51) Int. Cl.

| | |
|---|---|
| ***G05F 1/575*** | (2006.01) |
| ***G05F 1/59*** | (2006.01) |
| ***G05F 1/595*** | (2006.01) |

(52) U.S. Cl.

CPC ..... *G05F 1/575* (2013.01); *G05F 1/595* (2013.01); *G05F 1/59* (2013.01)

(58) Field of Classification Search

CPC ..... G05F 1/59; G05F 1/575; G05F 1/595
See application file for complete search history.

(56) References Cited

U.S. PATENT DOCUMENTS 6,807,040 B2 10/2004 Ivanov et al.
7,672,107 B2 * 3/2010 So ..... H02H 9/025 361/93.9
7,957,116 B2 * 6/2011 So ..... G05F 1/573 361/93.9
9,344,088 B1 * 5/2016 Sanchez ..... H03K 19/00384
9,467,098 B2 * 10/2016 Fan ..... H03F 1/32
2002/0181180 A1 * 12/2002 Ivanov ..... H03F 1/523 361/93.9
2009/0189577 A1 * 7/2009 Lin ..... G05F 1/56 323/273
2013/0169247 A1 7/2013 Onouchi et al.
2016/0043539 A1 * 2/2016 Mallala ..... G05F 1/569 361/18
2018/0284823 A1 10/2018 Na et al.
2019/0146530 A1 * 5/2019 Kotrc ..... G05F 1/575 323/265
2021/0096587 A1 * 4/2021 Shreepathi Bhat ..... G05F 1/575

OTHER PUBLICATIONS

Okuma, Yasuyuki et al. "0.5-V Input Digital LDO, with 98.7% Current Efficiency and 2.7-μA Quiescent Current in 35nm CMOS", IEEE, 4 pgs., (2010).

* cited by examiner

*Primary Examiner* — Thienvu V Tran
*Assistant Examiner* — Sisay G Tiku

(57) ABSTRACT

Embodiments of digital low-dropout (LDO) regulators and methods for operating a digital LDO regulator are described. In one embodiment, a digital LDO regulator includes a clamp circuit configured to generate a clamp voltage in response to an input voltage of the digital LDO regulator, a gate driver circuit configured to generate a drive voltage in response to the input voltage and the clamp voltage, and at least one transistor device configured to generate an output voltage in response to the input voltage and the drive voltage. Other embodiments are also described.

18 Claims, 4 Drawing Sheets

DIGITAL LOW-DROPOUT REGULATOR AND METHOD FOR OPERATING A DIGITAL LOW-DROPOUT REGULATOR

BACKGROUND

A digital low-dropout (LDO) regulator, which is also referred to as a DLDO regulator, converts an input voltage into an output voltage and can be used to provide a stable operating voltage to components of an integrated circuit (IC). In a digital LDO regulator, a variable supply voltage can result in the deviation of transistor current. Consequently, the deviation of transistor current can cause a large ripple voltage on the regulator output voltage and lead to reliability problems. Therefore, there is a need for a digital LDO regulator that can generate a stable output voltage under a variable supply voltage.

SUMMARY

Embodiments of digital LDO regulators and methods for operating a digital LDO regulator are described. In an embodiment, a digital LDO regulator includes a clamp circuit configured to generate a clamp voltage in response to an input voltage of the digital LDO regulator, a gate driver circuit configured to generate a drive voltage in response to the input voltage and the clamp voltage, and at least one transistor device configured to generate an output voltage in response to the input voltage and the drive voltage. Other embodiments are also described.

In an embodiment, the output voltage is constant.

In an embodiment, the at least one transistor device includes at least one PMOS power transistor.

In an embodiment, the gate driver circuit is electrically connected to a gate terminal of the at least one PMOS power transistor.

In an embodiment, the input voltage is applied to a source terminal of the at least one PMOS power transistor.

In an embodiment, a drain terminal of the at least one PMOS power transistor is electrically connected to an output terminal from which the output voltage is output.

In an embodiment, the clamp circuit includes transistor devices and current sources that are electrically connected to the transistor devices.

In an embodiment, the clamp circuit includes first and second PMOS transistors that are serially connected to the input voltage, a first current source electrically connected to the first and second PMOS transistors and to a fixed voltage, a third PMOS transistor electrically connected to the first and second PMOS transistors, to the first current source, and to the fixed voltage, and a second current source electrically connected between the input voltage and the third PMOS transistor.

In an embodiment, the gate driver circuit includes inverters.

In an embodiment, the digital LDO regulator includes a voltage comparator configured to compare a reference voltage with the output voltage to generate a comparison result.

In an embodiment, the digital LDO regulator includes a controller configured to control the at least one transistor device based on the comparison result.

In an embodiment, a digital LDO regulator includes a clamp circuit configured to generate a clamp voltage in response to an input voltage of the digital LDO regulator, a gate driver circuit configured to generate a drive voltage in response to the input voltage and the clamp voltage and at least one PMOS power transistor configured to generate a constant output voltage in response to the input voltage and the drive voltage, where the input voltage varies between a first voltage level and a second voltage level.

In an embodiment, the gate driver circuit is electrically connected to a gate terminal of the at least one PMOS power transistor, wherein the input voltage is applied to a source terminal of the at least one PMOS power transistor, and wherein a drain terminal of the at least one PMOS power transistor is electrically connected to an output terminal from which the constant output voltage is output.

In an embodiment, the clamp circuit includes transistor devices and a plurality of current sources that are electrically connected to the transistor devices.

In an embodiment, the clamp circuit includes first and second PMOS transistors that are serially connected to the input voltage, a first current source electrically connected to the first and second PMOS transistors and to a fixed voltage, a third PMOS transistor electrically connected to the first and second PMOS transistors, to the first current source, and to the fixed voltage, and a second current source electrically connected between the input voltage and the third PMOS transistor.

In an embodiment, the gate driver circuit includes inverters.

In an embodiment, a method for operating a digital LDO regulator involves generating a clamp voltage in response to an input voltage of the digital LDO regulator using a clamp circuit of the digital LDO regulator, generating a drive voltage in response to the input voltage and the clamp voltage using a gate driver circuit of the digital LDO regulator, and generating an output voltage in response to the input voltage and the drive voltage using at least one transistor device of the digital LDO regulator.

In an embodiment, the output voltage is constant.

In an embodiment, the input voltage varies between a first voltage level and a second voltage level.

In an embodiment, the at least one transistor device includes at least one PMOS power transistor.

Other aspects and advantages of embodiments of the present invention will become apparent from the following detailed description, taken in conjunction with the accompanying drawings, depicted by way of example of the principles of the invention.

BRIEF DESCRIPTION OF THE DRAWINGS

Throughout the description, similar reference numbers may be used to identify similar elements.

DETAILED DESCRIPTION

It will be readily understood that the components of the embodiments as generally described herein and illustrated in the appended figures could be arranged and designed in a wide variety of different configurations. Thus, the following detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

Figure 1:
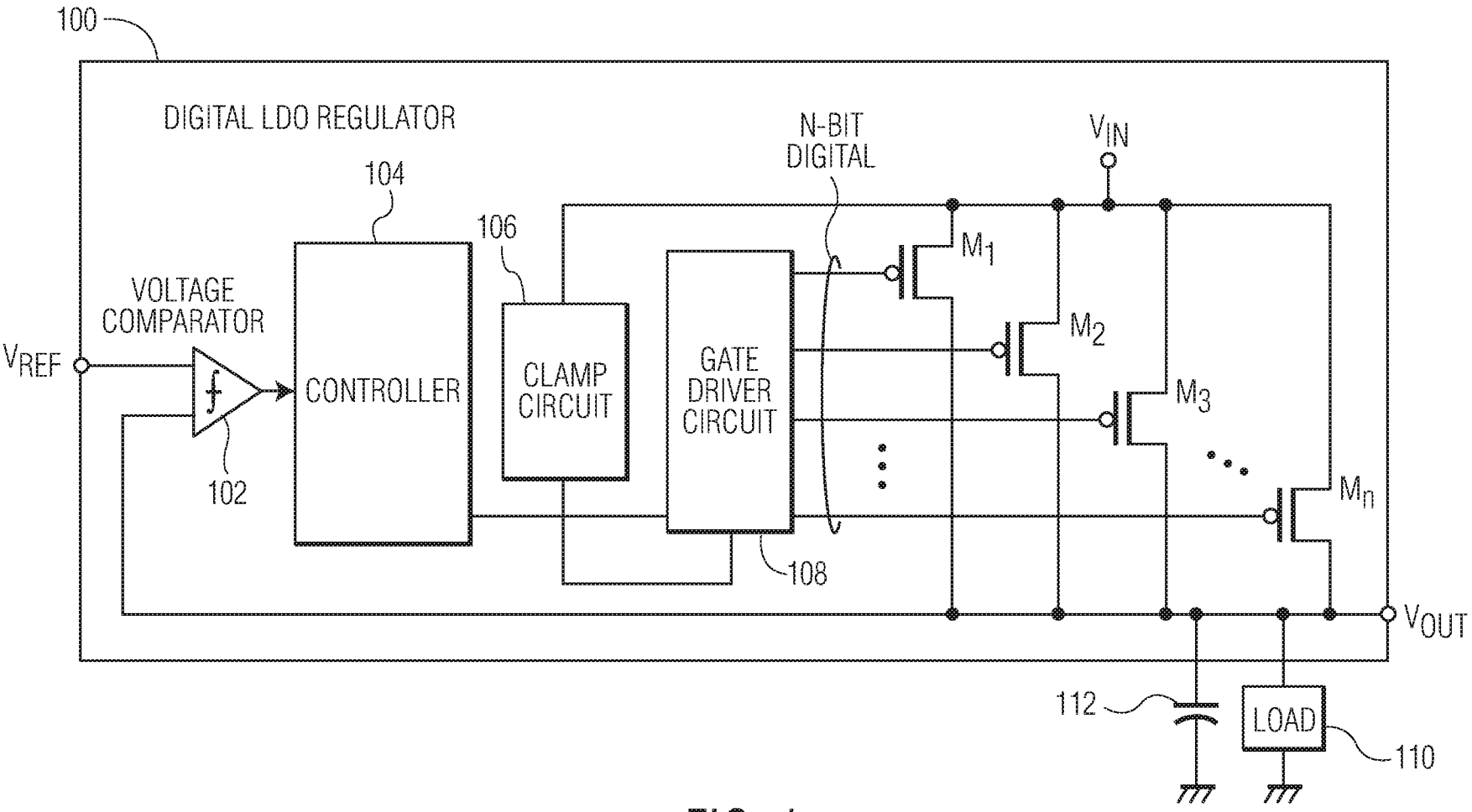
FIG. 1 is a schematic block diagram of a digital LDO regulator in accordance with an embodiment of the invention.

FIG. 1 is a schematic block diagram of a digital LDO regulator 100 in accordance with an embodiment of the invention. In the embodiment depicted in FIG. 1, the digital LDO regulator 100 includes a voltage comparator 102, a controller 104, a clamp circuit 106, at least one gate driver circuit 108, and at least one transistor device that is implemented as at least one PMOS power transistor, "$M_1$," . . . , "$M_N$," where N is an integer that is greater than zero. The digital LDO regulator converts an input voltage or a supply voltage, "$V_{IN}$," into an output voltage, "$V_{OUT}$," for a load 110, which may be electrically connected to a fixed voltage (e.g., electrical ground (zero volt)). The input and output voltages of the digital LDO regulator can be any suitable type of Direct Current (DC) voltages. The digital LDO regulator can be used to provide an operating voltage for components of an IC. In some embodiments, the digital LDO regulator converts an input voltage that is from 1.2 Volts (V) to 1.98V into an output voltage of 0.8V. However, the input and output voltages of the digital LDO regulator are not limited by the example voltages. Although the digital LDO regulator is shown in FIG. 1 as including certain components, in some embodiments, the digital LDO regulator includes less or more components to implement less or more functionalities. For example, although the digital LDO regulator is shown in FIG. 1 as including an array of PMOS power transistor(s), $M_1, \ldots, M_N$, in other embodiments, the digital LDO regulator may include one or more other semiconductor devices. In another example, in some embodiments, the digital LDO regulator includes a decoupling capacitor 112 that is electrically connected to a fixed voltage (e.g., electrical ground (zero volt)).

In the embodiment depicted in FIG. 1, the voltage comparator 102 is configured to compare a reference voltage, "$V_{REF}$," with the output voltage, $V_{OUT}$, of the digital LDO regulator 100 or a scaled version of the output voltage, $V_{OUT}$, to generate a comparison result. The voltage comparator can be implemented using various voltage comparison techniques that are well-known in the art.

In the embodiment depicted in FIG. 1, the controller 104 is configured to control the at least one PMOS power transistor, $M_1, \ldots, M_N$, based on the comparison result from the voltage comparator 102. The controller may be implemented in hardware (e.g., circuit or circuits), software, firmware, or a combination thereof. In an embodiment, the controller is implemented using a hardware processor, such as a microcontroller, a digital signal processor (DSP), or a central processing unit (CPU). In some embodiments, the controller is configured to enable (i.e., turn on/conducting) or disable (i.e., turn off/not conducting) the at least one PMOS power transistor, $M_1, \ldots, M_N$ of the digital LDO regulator 100. For example, the at least one PMOS power transistor, $M_1, \ldots, M_N$ works as one or more switches. Depending on the difference between the output voltage, $V_{OUT}$, of the digital LDO regulator 100, or a scaled version of the output voltage, $V_{OUT}$, and the reference voltage, $V_{REF}$, the at least one PMOS power transistor, $M_1, \ldots, M_N$ can be controlled (e.g., turned on) by the controller 104.

When a digital LDO regulator is used with a variable input voltage, such as in case the digital LDO regulator is powered by a battery, the current on each power transistor of the digital LDO regulator may have a large deviation, which can cause a large ripple voltage on the output voltage of the digital LDO regulator. In order to deliver enough power current under a low supply voltage, the resistance of each power transistor of a digital LDO regulator is generally low. Consequently, when the output voltage of the digital LDO regulator varies (e.g., increases), the digital LDO regulator may have large power current under high supply voltage, which can bring up large ripple on the output voltage of the digital LDO regulator, which is a key specification of the digital LDO regulator, reliability concerns, such as heating and aging issues, for the power transistors of the digital LDO regulator.

In the embodiment depicted in FIG. 1, the clamp circuit 106 is configured to generate a clamp voltage, "$V_{GATE_RAIL}$," based on the input voltage, $V_{IN}$, of the digital LDO regulator 100, the at least one gate driver circuit 108 is configured to generate at least one drive voltage in response to the input voltage, $V_{IN}$, of the digital LDO regulator 100 and the clamp voltage, $V_{GATE_RAIL}$, and the at least one power transistor, $M_1, \ldots, M_N$ is configured to generate the output voltage, $V_{OUT}$, of the digital LDO regulator 100 in response to the input voltage, $V_{IN}$, of the digital LDO regulator and the at least one drive voltage.

In the embodiment depicted in FIG. 1, the digital LDO regulator 100 uses the clamp circuit 106 to clamp the at least one PMOS power transistor, $M_1, \ldots, M_N$, for example, to operate in the saturation region by clamping the source-gate of the at least one PMOS power transistor, $M_1, \ldots, M_N$ to a constant voltage. Therefore, the current on each PMOS power transistor $M_1, \ldots,$ or $M_N$ can be less dependent from or even almost independent from the input voltage, $V_{IN}$, of the digital LDO regulator 100. Consequently, compared to a digital LDO regulator without a clamp circuit, the digital LDO regulator 100 depicted in FIG. 1 has a smaller ripple voltage on the output voltage, $V_{OUT}$, and as a result, less possibility that heating and aging issues on the reliability of the at least one PMOS power transistor, $M_1, \ldots, M_N$ can occur. In addition, in a digital LDO regulator without a clamp circuit, each power transistor works as a switch in the linear region. Because the at least one PMOS power transistor, $M_1, \ldots, M_N$ in the digital LDO regulator 100 works in the saturation region instead of the linear region, the digital LDO regulator 100 depicted in FIG. 1 provides better Power Supply Ripple Rejection (PSRR) especially for high frequencies that are out of the loop bandwidth. In addition, an overcurrent protection function is implemented in the digital LDO regulator 100 automatically such that the output short-to-ground current can be limited and constant when the digital LDO regulator 100 is shorted to ground, while the output short-to-ground current can be out of the normal range when a digital LDO regulator without a clamp circuit is shorted to ground.

Although the digital LDO regulator 100 is shown in FIG. 1 as a PMOS-type digital LDO regulator, the invention is also applicable for NMOS-type digital LDO regulators. When the digital LDO regulator 100 is implemented as an NMOS-type digital LDO regulator, the clamp circuit 106 is designed based on the output voltage, $V_{OUT}$, of the NMOS-type digital LDO regulator and the at least one gate driver circuit 108 operates between the clamp voltage and the output voltage, $V_{OUT}$.

Figure 2:
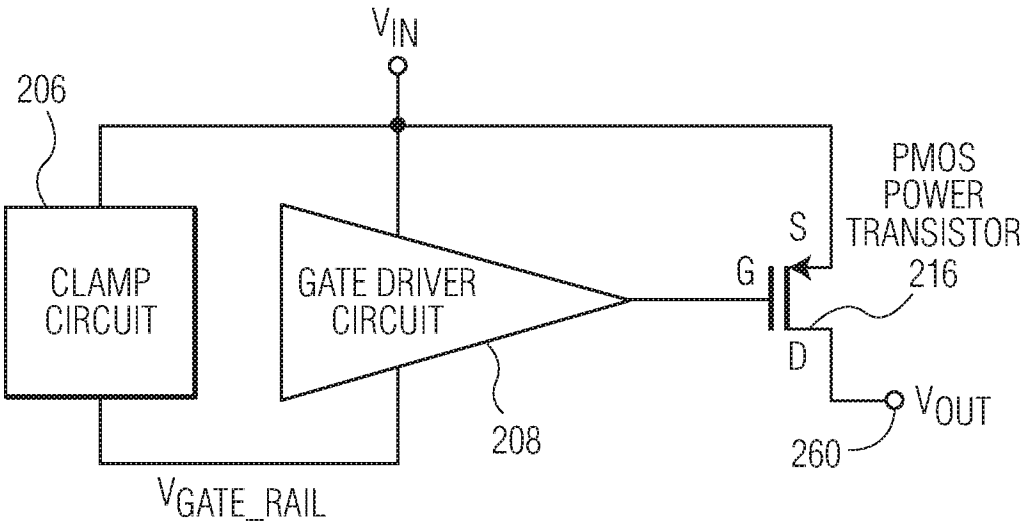
FIG. 2 depicts a clamp circuit, a gate driver circuit, and a PMOS power transistor that can be used in the digital LDO regulator depicted in FIG. 1.

FIG. 2 depicts a clamp circuit 206, a gate driver circuit 208 and a PMOS power transistor 216 that can be used in the digital LDO regulator 100 depicted in FIG. 1. The clamp circuit 206, the gate driver circuit 208 and the PMOS power transistor 216 depicted in FIG. 2 are embodiments of the clamp circuit 106, the at least one gate driver circuit 108 and the at least one PMOS power transistor, $M_1, \ldots, M_N$ of the digital LDO regulator 100 depicted in FIG. 1. However, the clamp circuit 106, the at least one gate driver circuit 108 and the at least one PMOS power transistor, $M_1, \ldots, M_N$ depicted in FIG. 1 are not limited to the embodiment shown in FIG. 2. In an embodiment, the input voltage or the supply voltage, $V_{IN}$, to the digital LDO regulator 100 varies between around (e.g., ±30%) 1.2V and around (e.g., ±30%) 1.98V, and the output voltage, $V_{OUT}$, is regulated to 0.8V. However, the input and output voltages of the digital LDO regulator 100 are not limited by the example voltages. The clamp circuit 206 generates an internal voltage, $V_{GATE_RAIL}$, based on the input voltage, V. The gate driver voltage that is generated by the gate driver circuit 208 is applied to the gate terminal, G, of the PMOS power transistor 216. The input voltage, $V_{IN}$, is applied to the source terminal, S, of the PMOS power transistor 216 and the drain terminal, D, of the PMOS power transistor 216 is electrically connected to an output terminal 260 from which the output voltage, $V_{OUT}$, is output. Consequently, the gate driver circuit 208 operates between the input voltage, $V_{IN}$, and the internal voltage, $V_{GATE_RAIL}$ When the PMOS power transistor 216 is turned on (i.e., conducting), the source-gate voltage of the PMOS power transistor 216 is clamped to a constant value (i.e., from the input voltage, $V_{IN}$, and the internal voltage, $V_{GATE_RAIL}$). When the source-gate voltage of the PMOS power transistor 216 is clamped to the constant value and the PMOS power transistor 216 operates in the saturation region its power current can be almost independent on the input voltage, $V_{IN}$.

Figure 3:
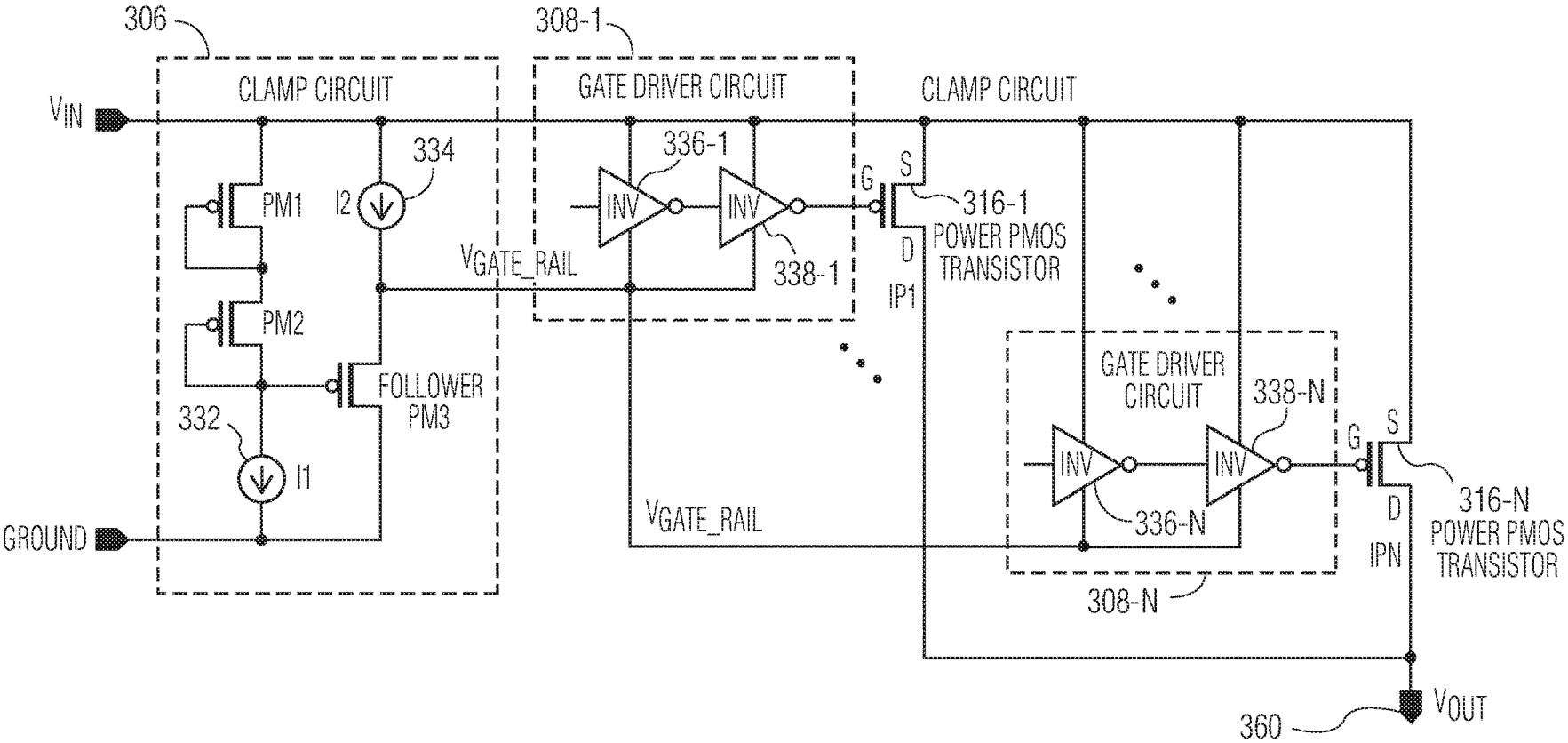
FIG. 3 depicts a clamp circuit, at least one gate driver circuit, and at least one PMOS power transistor that can be used in the digital LDO regulator depicted in FIG. 1.

FIG. 3 depicts a clamp circuit 306, at least one gate driver circuit 308-1, . . . , 308-N, where N is an integer that is greater than zero, and at least one PMOS power transistor 316-1, . . . , 316-N that can be used in the digital LDO regulator 100 depicted in FIG. 1. The clamp circuit 306, the at least one gate driver circuit 308-1, . . . , 308-N, and the at least one PMOS power transistor 316-1, . . . , 316-N depicted in FIG. 3 are embodiments of the clamp circuit 106, the at least one gate driver circuit 108 and the at least one PMOS power transistor, $M_1, \ldots, M_N$ of the digital LDO regulator 100 depicted in FIG. 1. However, the clamp circuit 106, the at least one gate driver circuit 108 and the at least one PMOS power transistor, $M_1, \ldots, M_N$ depicted in FIG. 1 are not limited to the embodiment shown in FIG. 3. In the embodiment depicted in FIG. 3, the clamp circuit 306 includes a current source 332 configured to generate a constant current, I1, a current source 334 configured to generate a constant current, I2, two diode-connected PMOS transistors, PM1, PM2, which are connected to a PMOS transistor, PM3, that acts as a source follower. The current source 332 and the PMOS transistors, PM3, are electrically connected to a fixed voltage, such as ground (0V). In the embodiment depicted in FIG. 3, the PMOS transistors, PM1, PM2, are connected to the input voltage, $V_{IN}$, the current source 332 is electrically connected to the PMOS transistors, PM1, PM2, and to ground, the PMOS transistor, PM3, is electrically connected to the PMOS transistors, PM1, PM2, to the current source 332, and to ground, and the current source 334 is electrically connected between the input voltage, $V_{IN}$, and the PMOS transistor, PM3. The clamp circuit 306 generates an internal voltage, $V_{GATE_RAIL}$, based on the input voltage, $V_{IN}$. In the embodiment depicted in FIG. 3, the gate driver circuit 308-1 includes at least two inverters 336-1, 338-1 that operate between the input voltage, $V_{IN}$, and the internal voltage, $V_{GATE_RAIL}$. The driver voltage that is generated by the gate driver circuit 308-1 is applied to the gate terminal, G, of the PMOS power transistor 316-1. The input voltage, $V_{IN}$, is applied to the source terminal, S, of the PMOS power transistor 316-1 and the drain terminal, D, of the PMOS power transistor 316-1 is electrically connected to an output terminal 360 from which the output voltage, $V_{OUT}$, is output. The gate driver circuit 308-N includes at least two inverters 336-N, 338-N that operate between the input voltage, $V_{IN}$, and the internal voltage, $V_{GATE_RAIL}$. The driver voltage that is generated by the gate driver circuit 308-N is applied to the gate terminal, G, of the PMOS power transistor 316-N. The input voltage, $V_{IN}$, is applied to the source terminal, S, of the PMOS power transistor 316-N and the drain terminal, D, of the PMOS power transistor 316-N is electrically connected to the output terminal 360 from which the output voltage, $V_{OUT}$, is output.

In the embodiment depicted in FIG. 3, the voltage difference, $V_{DIFF}$, between the input voltage, $V_{IN}$, and the internal voltage, $V_{GATE_RAIL}$, can be expressed as:

$$V_{DIFF}=V_{SG_PM1}+V_{SG_PM2}-V_{SG_PM3}, \quad (1)$$

where $V_{SG_PM1}$ represents the source-gate voltage of the PMOS transistor, PM1, $V_{SG_PM2}$ represents the source-gate voltage of the PMOS transistor, PM2, and $V_{SG_PM3}$ represents the source-gate voltage of the PMOS transistor, PM3. In case that the PMOS transistors, PM2, PM3, are identical to each other, the voltage difference, $V_{DIFF}$, between the input voltage, $V_{IN}$, and the internal voltage, $V_{GATE_RAIL}$, is equal to the source-gate voltage, $V_{SG_PM1}$, of the PMOS transistor, PM1. When the PMOS power transistor 316-1 is turn on (i.e., conductive), the gate voltage of the PMOS power transistor 316-1 is pulled down to the internal voltage, $V_{GATE_RAIL}$, by the gate driver circuit 308-1. The PMOS transistor, PM1, and the PMOS power transistor 316-1 work as a current mirror when the PMOS power transistor 316-1 operates in the saturation region (e.g., when the source-drain voltage, $V_{SD}$, of the PMOS power transistor 316-1 is higher than a threshold). When the PMOS power transistor 316-1 operates in the saturation region, the current, $I_{P1}$, conducted by the PMOS power transistor 316-1 can be expressed as:

$$I_{P1}=I_1*(WL_{PPT})/(W_{PM1}), \quad (1)$$

where $WL_{PPT}$ represents the W/L ratio of the PMOS power transistor 316-1, and $WL_{PPT}$ represents the W/L ratio of the PMOS transistor, PM1. Consequently, when the reference current, I1, is constant, the current, $I_{P1}$, conducted by the PMOS power transistor 316-1 is constant. The PMOS power transistor 316-N and the gate driver circuit 308-N operate similarly to or identically with the PMOS power transistor 316-1 and the gate driver circuit 308-1, respectively.

Figure 4:
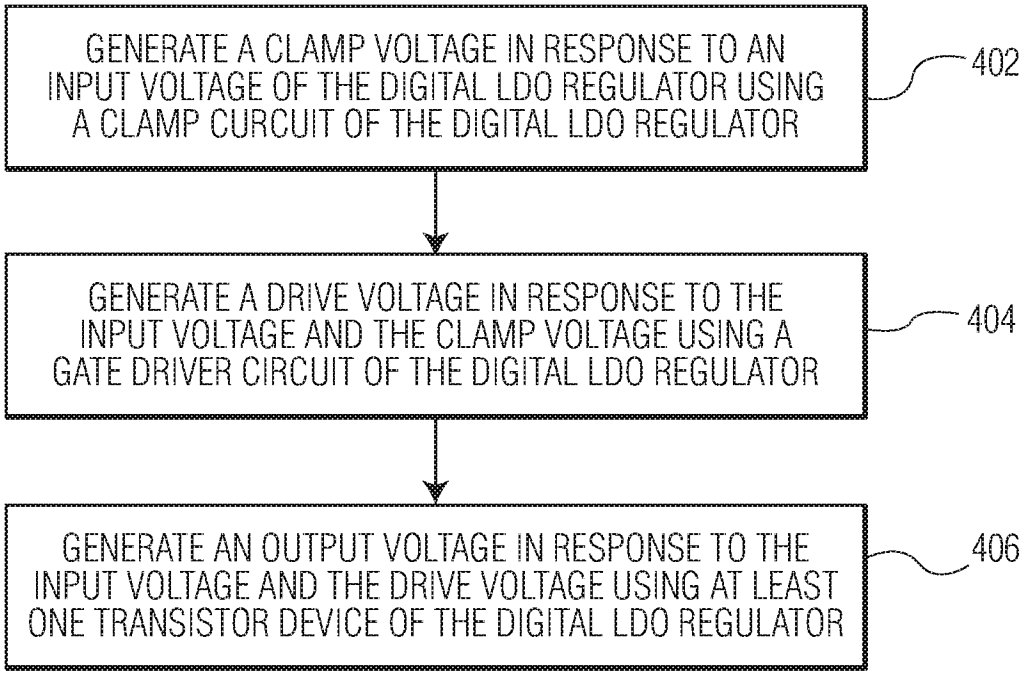
FIG. 4 is a process flow diagram of a method for operating a digital LDO regulator in accordance with an embodiment of the invention.

FIG. 4 is a process flow diagram of a method for operating a digital LDO regulator in accordance with an embodiment of the invention. The digital LDO regulator may be similar to or the same as the digital LDO regulator 100 depicted in FIG. 1. At block 402, a clamp voltage is generated in response to an input voltage of the digital LDO regulator using a clamp circuit of the digital LDO regulator. At block 404, a drive voltage is generated in response to the input voltage and the clamp voltage using a gate driver circuit of the digital LDO regulator. At block 406, an output voltage is generated in response to the input voltage and the drive voltage using at least one transistor device of the digital LDO regulator.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

It should also be noted that at least some of the operations for the methods described herein may be implemented using software instructions stored on a computer useable storage medium for execution by a computer. As an example, an embodiment of a computer program product includes a computer useable storage medium to store a computer readable program. The computer-useable or computer-readable storage medium can be an electronic, magnetic, optical, electromagnetic, infrared, or semiconductor system (or apparatus or device). Examples of non-transitory computer-useable and computer-readable storage media include a semiconductor or solid state memory, magnetic tape, a removable computer diskette, electrically erasable programmable read-only memory (EEPROM), a random access memory (RAM), a read-only memory (ROM), a rigid magnetic disk, and an optical disk. Current examples of optical disks include a compact disk with read only memory (CD-ROM), a compact disk with read/write (CD-R/W), and a digital video disk (DVD).

Alternatively, embodiments of the invention may be implemented entirely in hardware or in an implementation containing both hardware and software elements. In embodiments which use software, the software may include but is not limited to firmware, resident software, microcode, etc.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A digital low-dropout (LDO) regulator, the digital LDO regulator comprising:

a clamp circuit configured to generate a clamp voltage in response to an input voltage of the digital LDO regulator;

a gate driver circuit configured to generate a drive voltage in response to the input voltage and the clamp voltage; and at least one transistor device configured to generate an output voltage in response to the input voltage and the drive voltage, wherein the clamp circuit comprises:

first and second PMOS transistors that are serially connected to the input voltage;

a first current source electrically connected to the first and second PMOS transistors and to a fixed voltage;

a third PMOS transistor electrically connected to the first and second PMOS transistors, to the first current source, and to the fixed voltage; and a second current source electrically connected between the input voltage and the third PMOS transistor.

2. The digital LDO regulator of claim 1, wherein the output voltage is constant.

3. The digital LDO regulator of claim 1, wherein the at least one transistor device comprises at least one PMOS power transistor.

4. The digital LDO regulator of claim 3, wherein the gate driver circuit is electrically connected to a gate terminal of the at least one PMOS power transistor.

5. The digital LDO regulator of claim 4, wherein the input voltage is applied to a source terminal of the at least one PMOS power transistor.

6. The digital LDO regulator of claim 5, wherein a drain terminal of the at least one PMOS power transistor is electrically connected to an output terminal from which the output voltage is output.

7. The digital LDO regulator of claim 1, wherein the clamp circuit comprises a plurality of transistor devices and a plurality of current sources that are electrically connected to the transistor devices.

8. The digital LDO regulator of claim 1, wherein the gate driver circuit comprises a plurality of inverters.

9. The digital LDO regulator of claim 1, further comprising a voltage comparator configured to compare a reference voltage with the output voltage to generate a comparison result.

10. The digital LDO regulator of claim 9, further comprising a controller configured to control the at least one transistor device based on the comparison result.

11. A digital low-dropout (LDO) regulator, the digital LDO regulator comprising:

a clamp circuit configured to generate a clamp voltage in response to an input voltage of the digital LDO regulator;

a gate driver circuit configured to generate a drive voltage in response to the input voltage and the clamp voltage; and at least one PMOS power transistor configured to generate a constant output voltage in response to the input voltage and the drive voltage, wherein the input voltage varies between a first voltage level and a second voltage level, wherein the clamp circuit comprises:

first and second PMOS transistors that are serially connected to the input voltage;

a first current source electrically connected to the first and second PMOS transistors and to a fixed voltage;

a third PMOS transistor electrically connected to the first and second PMOS transistors, to the first current source, and to the fixed voltage; and a second current source electrically connected between the input voltage and the third PMOS transistor.

12. The digital LDO regulator of claim 11, wherein the gate driver circuit is electrically connected to a gate terminal of the at least one PMOS power transistor, wherein the input voltage is applied to a source terminal of the at least one PMOS power transistor, and wherein a drain terminal of the at least one PMOS power transistor is electrically connected to an output terminal from which the constant output voltage is output.

13. The digital LDO regulator of claim 11, wherein the clamp circuit comprises a plurality of transistor devices and a plurality of current sources that are electrically connected to the transistor devices.

14. The digital LDO regulator of claim 11, wherein the gate driver circuit comprises a plurality of inverters.

15. A method for operating a digital low-dropout (LDO) regulator, the method comprising:

generating a clamp voltage in response to an input voltage of the digital LDO regulator using a clamp circuit of the digital LDO regulator;

generating a drive voltage in response to the input voltage and the clamp voltage using a gate driver circuit of the digital LDO regulator; and generating an output voltage in response to the input voltage and the drive voltage using at least one transistor device of the digital LDO regulator, wherein the clamp circuit comprises:

first and second PMOS transistors that are serially connected to the input voltage;

a first current source electrically connected to the first and second PMOS transistors and to a fixed voltage;

a third PMOS transistor electrically connected to the first and second PMOS transistors, to the first current source, and to the fixed voltage; and a second current source electrically connected between the input voltage and the third PMOS transistor.

16. The method of claim 15, wherein the output voltage is constant.

17. The method of claim 16, wherein the input voltage varies between a first voltage level and a second voltage level.

18. The method of claim 15, wherein the at least one transistor device comprises at least one PMOS power transistor.

* * * * *